United States Patent [19]

Ward et al.

[11] Patent Number: 4,761,087

[45] Date of Patent: Aug. 2, 1988

[54] PRINTER WITH AUTOMATIC PRINTED PAPER ADVANCEMENT TO TEAR-OFF POSITION AND SUBSEQUENT RETRACTION TO NEW FIRST PRINT LINE

[75] Inventors: David O. Ward, Waynesboro; Theodore S. Zajac, Jr., Charlottesville, both of Va.

[73] Assignee: Genicom Corporation, Waynesboro, Va.

[21] Appl. No.: 797,121

[22] Filed: Nov. 12, 1985

[51] Int. Cl.[4] ..... B41J 11/66

[52] U.S. Cl. ..... 400/621; 400/551; 400/605; 400/613.2; 400/616.1; 400/620; 400/639

[58] Field of Search ..... 400/551, 605, 616, 616.1, 400/616.2, 616.3, 620, 621, 637.1, 639.1, 639.2, 577, 613.2, 613.3, 613.4, 625, 639

[56] References Cited

U.S. PATENT DOCUMENTS

| | | | |
|---|---|---|---|
| 3,075,626 | 1/1963 | Schultz | 400/620 X |
| 3,217,855 | 11/1965 | Haberkorn et al. | 400/551 |
| 3,618,738 | 11/1971 | Boyatt et al. | 400/551 |
| 3,844,395 | 10/1974 | Mero et al. | 400/620 |
| 4,195,940 | 4/1980 | Rekewitz | 400/551 X |
| 4,234,261 | 11/1980 | Hendrischk et al. | 400/621 |
| 4,422,787 | 12/1983 | Guthrie | 400/621 |
| 4,452,543 | 6/1984 | Adkisson et al. | 400/639.1 X |
| 4,645,365 | 2/1987 | Iwai | 400/551 X |

FOREIGN PATENT DOCUMENTS

| | | | |
|---|---|---|---|
| 0084885 | 5/1982 | Japan | 400/639.1 |
| 0107873 | 7/1982 | Japan | 400/639.1 |
| 0167283 | 10/1982 | Japan | 400/620 |
| 0118481 | 7/1984 | Japan | 400/639.1 |
| 0176064 | 10/1984 | Japan | 400/551 |

OTHER PUBLICATIONS

IBM Technical Disclosure Bulletin, "Automatic Platen Indexing System", Paulson, vol. 18, No. 10, Mar. 1976, p. 3352.

*Primary Examiner*—Ernest T. Wright, Jr.
*Attorney, Agent, or Firm*—Nixon & Vanderhye

[57] ABSTRACT

A printer is provided with a controllable bail located between a print station and a downstream paper tear-off station. Upon occurrence of a first control signal, a printed portion of the paper is advanced to a desired tear-off position adjacent the tear-off station. Thereafter (after a predetermined time delay or after operator switch actuation), the paper is retracted to a new first print line position at the print station. The intermediately located bail is released at least after the leading edge of the paper is retracted thereunder and until sufficient paper is again advanced (e.g. during new printing operations) to ensure that paper is again located between the printing platen and the bail before the bail is re-engaged.

17 Claims, 3 Drawing Sheets

PRINTER WITH AUTOMATIC PRINTED PAPER ADVANCEMENT TO TEAR-OFF POSITION AND SUBSEQUENT RETRACTION TO NEW FIRST PRINT LINE

This application relates generally to printers of the type commonly used as output devices in computer control data processing systems and the like.

This application is related to commonly assigned co-pending application Ser. No. 797,119, filed Nov. 12, 1985, naming Messrs. Ward, Zajac and Hadtke as inventors, now abandoned.

Computer driven printers are now common place. Typically, individual sheets are or continuous form paper is fed past a platen at a printing station where desired visual indicia are transferred to the paper surface (e.g. via an ink ribbon, dot matrix print head, etc.). It is also common to use a paper bail located just downstream of the print station so as to maintain the paper in contact with the plate surface throughout the printing operation before the printed portion of the paper completely exits from the printer.

It is also typical to include a tear-off station so that a printed page or other portion of the paper may be neatly and conveniently torn off (or separated at a line of preformed perforations or the like). In some printers, the tear-off station is coincident with the bail. In other printers the tear-off station may be located a substantial distance downstream from the bail member.

Typically, in prior art arrangements, the bail is manually operated and the tear-off function is manually achieved by manual manipulation of the platen, for example, so as to advance the paper as desired to the tear-off position and/or to retract the paper after tear-off to a desired new line of print position.

The present invention includes a power driven bail member which, in conjunction with the paper drive mechanism, is programmed so as to automatically facilitate the paper tear-off function in an efficient and advantageous manner.

In the exemplary embodiment the novel tear-off function is initiated by a first control signal which may, for example, be generated by an operator manipulated switch. Alternatively, the first control signal might be generated by the printer control circuits when an end-of-printed document signal or the like is generated.

In response to this first control signal, the paper is advanced so that the last printed line is moved downstream of the tear-off station leaving the paper in a position where it can be immediately severed and used by an operator.

Thereafter, a second control signal is generated (e.g. after some predetermined time lapse from the first control signal and/or in response to manual operator switch actuation or the like) so as to retract the new leading edge of the remaining paper into a desired new first print line position at the printing station. Typically, such retraction will temporarily cause the leading edge of the paper to pass upstream of the bail. Accordingly, a power-driven bail is provided so that it may be released at least after such paper retraction until the paper is again advanced (e.g. during subsequent printing operations) to the point where paper is again disposed between the bail position and the platen whereupon the bail again may be actuated.

In the preferred exemplary embodiment, a more complex bail actuation/de-actuation sequence may also be employed so as to even further facilitate the tear-off function. In this more complex sequence, the paper bail is additionally released during paper advancement to the tear-off station and then re-applied to more firmly hold the paper in position during the tear-off operation. Subsequently, the bail bias may also be released again during retraction of the paper to the new desired print line position. Of course, if the new leading edge of the paper is not retracted upstream of the bail, then the bail bias may immediately be applied once the paper is in the new print line position. Otherwise, the bail bias should remain deactivated until sufficient new printing has occurred to again pass paper between the bail and the platen.

These as well as other objects and advantages of this invention will be more completely understood and appreciated by careful study of the following detailed description of the presently preferred exemplary embodiment taken in conjunction with the accompanying drawings of which:

Figure 1:
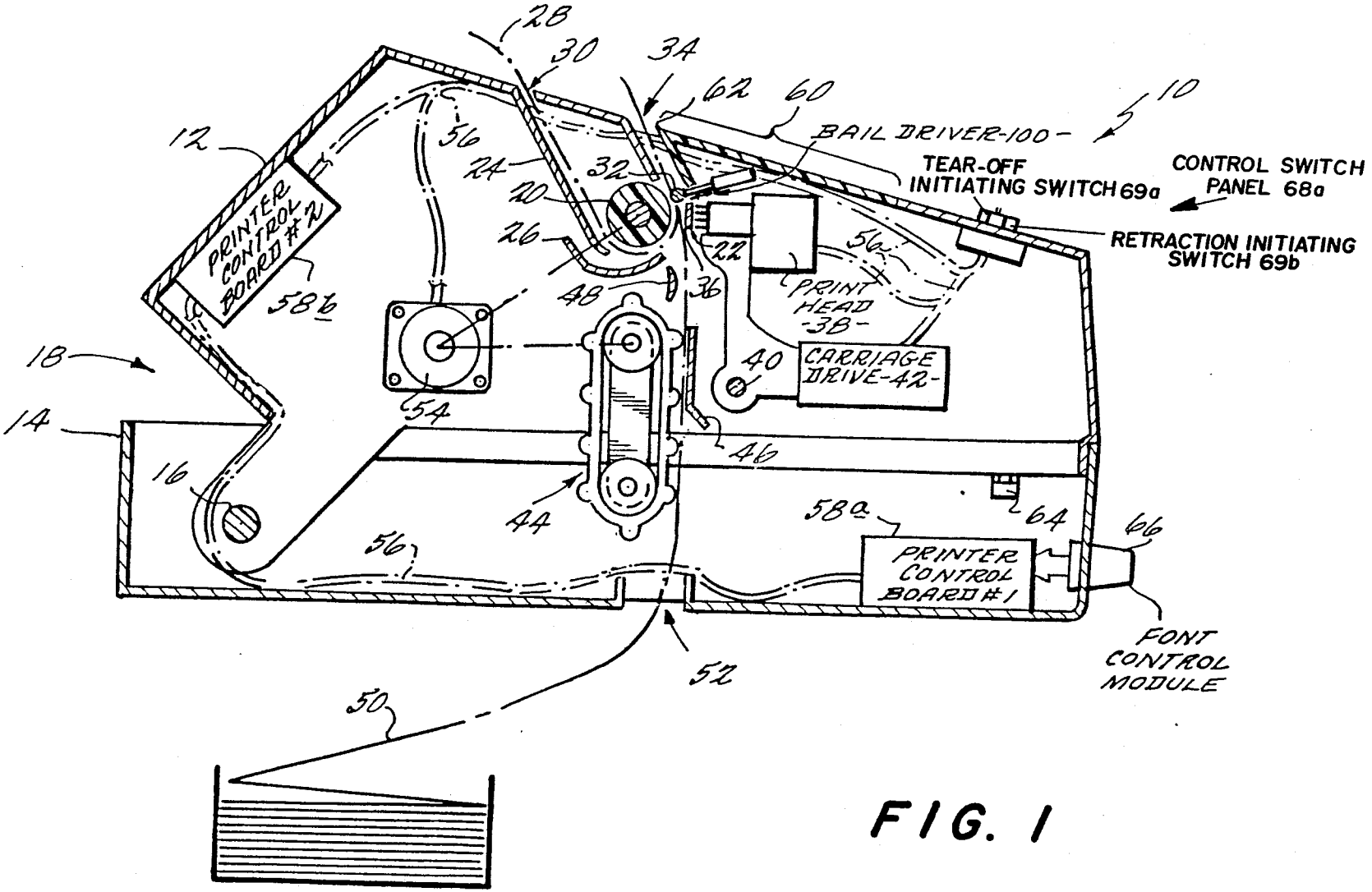
FIG. 1 is a schematic cross-sectional view of an exemplary embodiment of a printer constructed in accordance with this invention.
Figure 3:
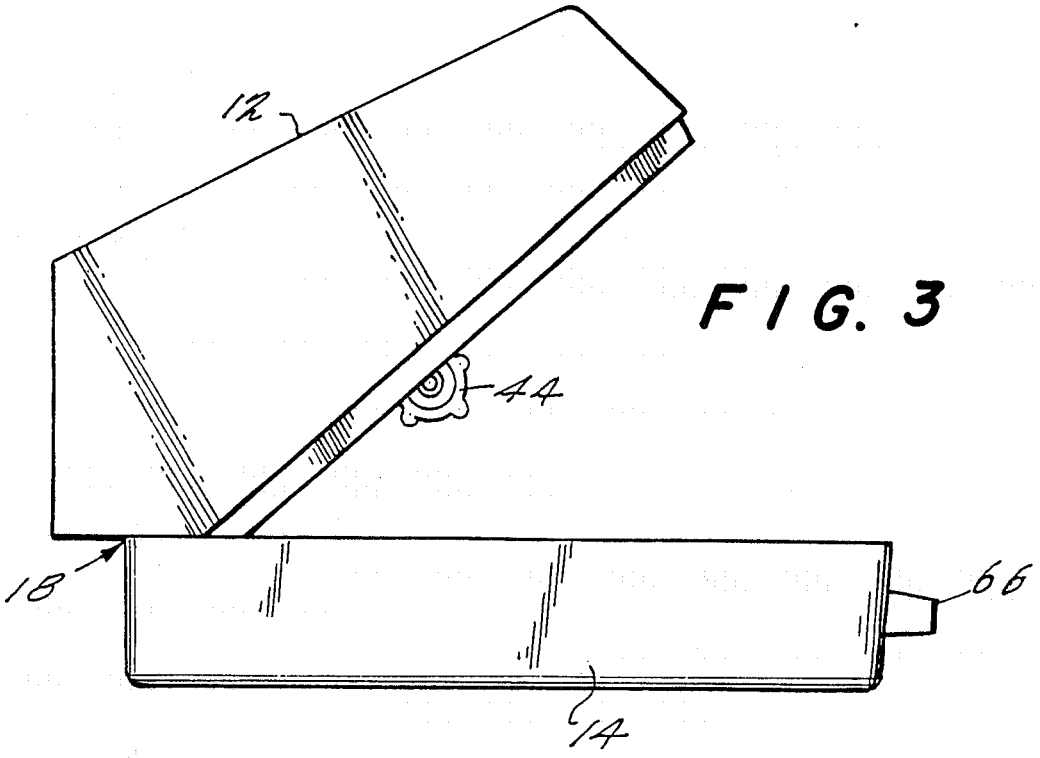
FIG. 3 is a side elevational view of the exemplary embodiment shown in FIG. 1.

An exemplary embodiment of the printer 10 is depicted at FIGS. 1 and 3. It generally includes an upper housing member 12 and a lower housing member 14 hingedly connected at 16 near the lower rear portion of the lower housing member 14. A rear portion of the housing members 12 and 14 include an angular configuration at 18 so as to accommodate a rotational opening motion to the open position. As will be observed, in the open position the rear relatively angled portions of the housing members 12, 14 fit in abutting relationship. However, rather than to place the rotational connection near the parting line between the upper and lower housing members 12 and 14 (e.g. near the apex of the angled section 18), the preferred embodiment places the rotatable connection 16 at a lower rear location within the lower housing member 14 thus providing a rearward "over center" type of movement which provides an even wider open mouth in the paper loading access position.

The printer 10 includes the usual rotatable platen 20 which has a print station 22 located at its front side where printed indicia are imparted to a paper surface carried by the front side of the platen 20. Suitable guides 24, 26 may be conventionally provided for directing individual form sheets 28 input through an entrance slot 30 into engagement with the rear side of the platen 20 such that, upon rotation of the platen 20, the paper sheet 28 is directed around and past print station 22, under paper bail 32 and out paper exit slot 34. Printing may be performed at print station 22 by any conventional printing mechanism such as, for example, a conventional driven print ribbon 36 and a dot matrix print head 38 which is driven transversely along carriage support shaft 40 by conventional carriage drive mechanism 42.

A continuous form tractor drive 44 (of conventional design) is mounted below the platen 20 and includes suitable paper guides 46, 48 so as to pull continuous form fan fold paper 50 or the like through a paper entrance slot 52 in the bottom of the lower housing member 14 and upwardly into engagement with the front side of platen 20 past the print station 22, under bail 32 and through paper exit slot 34. One or more conventional motors 42, 54 may be utilized for individually driving the print head 38 along the carriage support 40, the ribbon 36 with respect to the print head 38, the platen 20 and the tractor drive 44. In the schematic depiction of FIG. 1, a single motor 54 has been schematically depicted for simplicity.

In the exemplary embodiment, all of the mechanically driven components, including the tractor drive 44 are carried by the upper housing member 12. The electronic printer controller 58*a*, 58*b* may be housed where convenient. As depicted in FIG. 1, the printer controller might comprise two printer circuit boards 58*a*, 58*b*, one of which (board number 1) is mounted in the lower housing member 14 while the other (printer control board number 2) may be mounted in the upper housing member 12. Multiconductor cabling 56 may then be routed around the interior edges of the printer housing members 12, 14 and in proximity with the rotational point 16 so as to interconnect the printer controller boards 58*a*, 58*b*, the various drive motors 42 54, wire driving electromagnets and print head 38, the carriage drive motor 42, etc.

A transparent section 60 is also preferably provided so as to permit viewing of the print station area (or at least a view of the line that has just previously been printed) before the paper 50 or paper sheet 28 exits from slot 34. In addition, a sharp edge 62 may be provided in the transparent section 60 along the front of the exit slot 34 so as to provide a convenient tear off position for paper that has previously been printed (this is especially useful for the continuous form paper 50 as will be appreciated).

Figure 2:
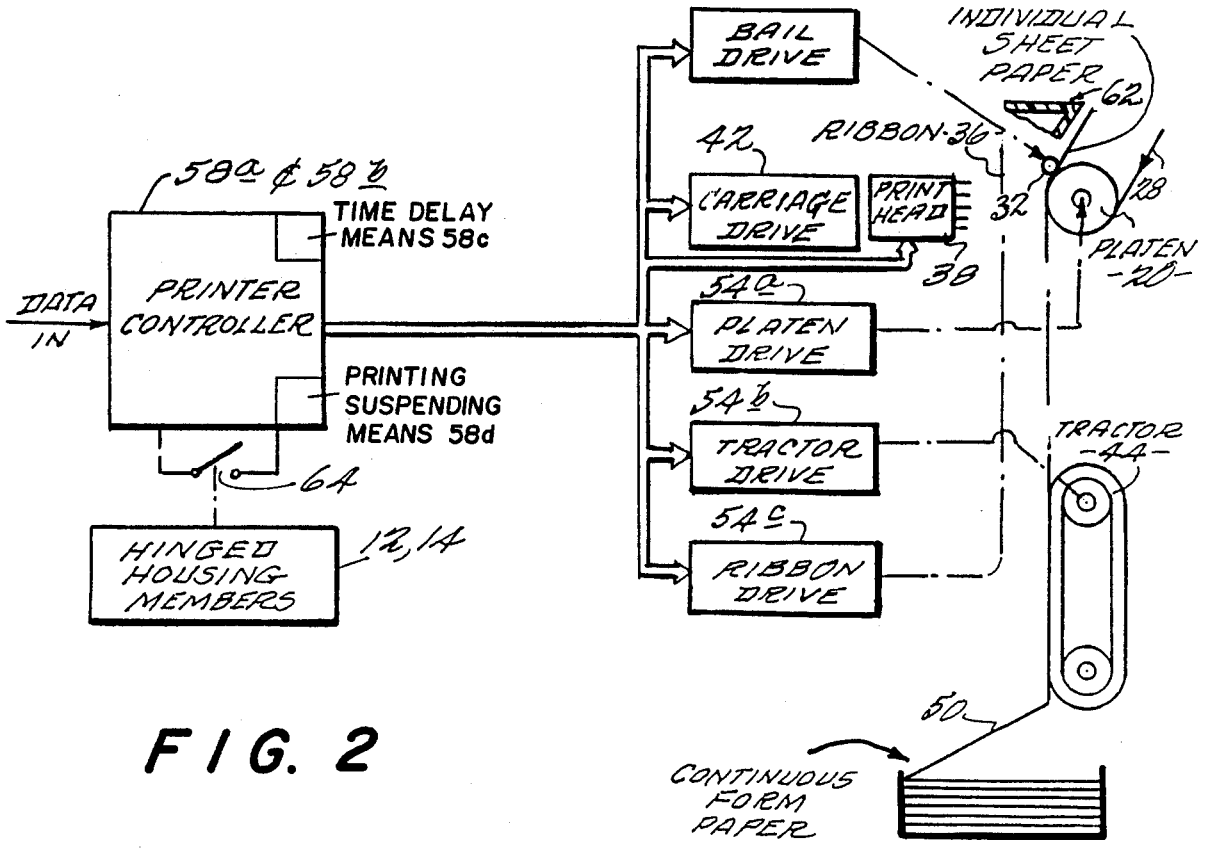
FIG. 2 is a schematic diagram of the electrical control circuits for the exemplary embodiment of FIG. 1.

As schematically depicted in FIG. 2, the printer controller 58*a*, 58*b* may be connected to a convenience switch 64 that is actuated to a predetermined opened or closed position whenever the hinged housing members 12, 14 are opened such that the printer controller 58*a*, 58*b* can be conditioned to automatically cease any printing operation whenever the housing members 12, 14 are rotated away from the closed position. One possible location for such a switch 64 is also depicted schematically in FIG. 1. The printer controller 58*a*, 58*b* may also accept plug in font control modules 66 so as to permit convenient operator control of the printing font. The usual operator control switch panel 68*a* is also provided and interconnected via multiconductor cabling 56 to the appropriate printer control boards 58*a*, 58*b*. As shown in FIG. 1, in addition to conventional control switches, switch panel 68*a* includes a tear-off operation initiating switch 69*a*. Additionally, a second switch 69*b* is shown on switch panel 68*a* which serves to initiate paper retraction to complete the tear-off operation sequence as is explained further below. A manual drive knob (not shown) may also be provided for the platen 20. Conventional drive mechanisms 54*a*, 54*b*, 54*c* may be employed for driving the platen 20, tractor drive 44 and ribbon 36, respectively.

As shown, the exemplary embodiment includes an electro-mechanical bail drive mechanism 100 (e.g. a motor, electromagnetic actuator, etc.) which is capable of physically moving the bail 32 into a pressure biased position against the platen 20 or away therefrom so as to permit paper 50 or paper sheet 28 to freely pass between the bail 32 and the platen 20. In the exemplary embodiment, the bail 32 is energized into engagement with the platen 20 so as to engage an intermediate paper 50 or paper sheet 28 whenever there is paper 50 or paper sheet 28 present at that location and either (a) a printing operation is underway or (b) the paper 50 or paper sheet 28 is in position for operator tear-off. Alternatively, the bail 32 may be left in engagement with the paper 50 or paper sheet 28 at all times except in the event that the new leading edge of the paper 50 or paper sheet 28 (i.e. after a tear-off function has occurred) is retracted sufficiently upstream as to temporarily result in an absence of paper 50 or paper sheet 28 between the bail 32 and the platen 20. In this later event, the bail drive 100 is deactivated so as to retract the bail 32 and permit free paper movements thereunder during subsequent printing/paper advancement times until paper 50 or paper sheet 28 once again is present between the bail 32 and the platen 20 whereupon the bail drive member 100 may again be actuated.

As shown in FIG. 2, there may be a significant distance between the paper bail 32 and the paper tear-off station or edge 62 (e.g. it might be as much as six lines or so of print positions). The distance between the bail 32 and the tear-off edge 62 will, of course, vary from one embodiment to the next in accordance with the printer design criteria.

Figure 4:
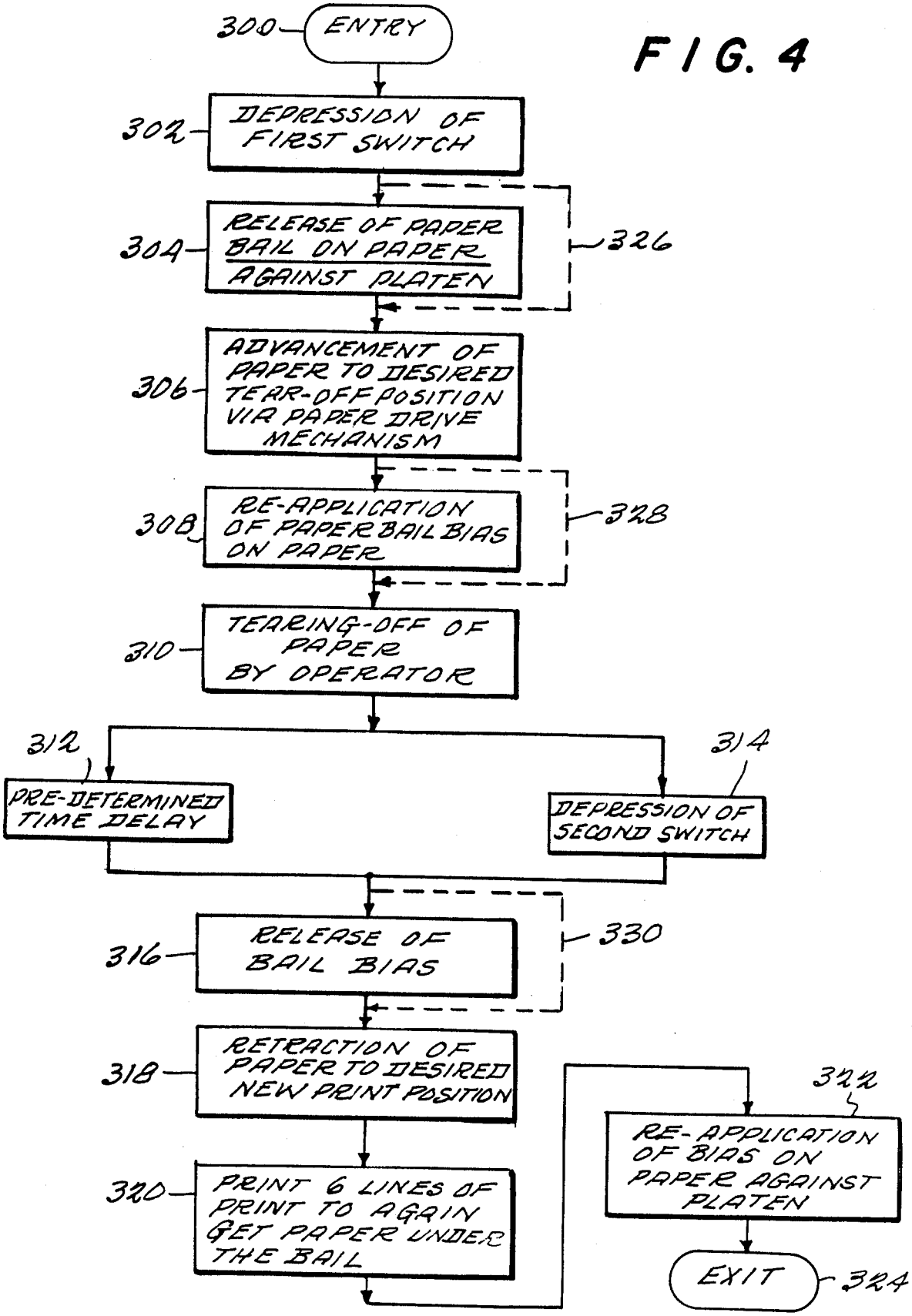
FIG. 4 is a flow chart of a suitable tear-off control function program sequence which may be embodied in the microprocessor-based printer controller of the exemplary embodiment.

The printer controller 58*a*, 58*b* which drives all of the printer mechanisms including the bail drive 100, is in the exemplary embodiment a microprocessor-based device. Insofar as the present invention is concerned, the microprocessor controller 58*a*, 58*b* may be of conventional design except for the tear-off function which may be embodied in a suitable computer program of the type depicted in the flow chart of FIG. 4. Microprocessor controller 58*a*, 58*b*, may, for example, be a commercially available NEC 7810 microprocessor manufactured by NEC Electronics, Inc. As will be appreciated, this tear-off function program may be embodied as a separate sub-routine or embodied directly within other printer controller program routines.

Entry to the tear-off function at step 300 may actually occur as a result of an interrupt signal or the like which may occur at step 302 or as a result of depression of an operator tear-off initiating control switch 69*a* (e.g. one of switches on the control panel 68*a*). Alternatively, an end of document control signal or the like may suffice for creation of a first control signal which causes entry to the tear-off function routine. In the exemplary embodiment, the paper bail 32 is released at step 304 and the paper 50 or paper sheet 28 is thereafter advanced at step 306 to a desired tear-off position via the conventional paper drive mechanism 54. Then, the paper bail bias is re-applied at step 308 and time is provided for an operator manual tear-off function (or automatic tear-off, cutting, etc.) at step 310 either by a predetermined time delay at step 312 by conventional time delay means 58*c* or until depression of a second one of the switches on control panel 68*a* (e.g., retraction initiating switch 69*b* shown in FIG. 1) at step 314 (or otherwise generating a second control signal by program or other means) before progressing further in a tear-off function flow chart of FIG. 4.

At the conclusion of the actual tear-off time (as defined by the initiation of a second control signal via steps 312 or 314), the bail bias is again released at step 316 and the new leading edge of the paper 50 or paper sheet 28 is retracted at step 318 to a desired new print position. In the exemplary embodiment, there is sufficient distance between the bail 32 and the tear-off edge 82 that the new leading edge is actually retracted past the bail 32. Accordingly, approximately six lines of new print is permitted at step 320 before paper 50 or paper sheet 28 is again located under the bail 32 and the bail bias may again be reapplied at step 322 before the tear-off function is completed at exit point 324. During steps 302 through 318 printing is suspended by conventional printing suspending means 58*d*.

As will be appreciated, if six lines of normal printing operations are to occur at step 320 before the bail bias is re-applied at step 322, then step 322 may actually be embodied within the normal print routine in conjunction with suitable data flags or the like indicating that a new printing operation has been initiated just subsequent to a tear-off function so that step 322 is to be performed after six lines worth of paper advancement have occurred.

Since paper 50 or paper sheet 28 may normally be driven past the biased bail position, one may alternately by-pass the bail release steps as indicated by dotted lines 326, 328 and 330. However, if the retraction step 318 actually withdraws the new leading edge of the paper upstream of the bail location, then the bail bias must be released at least sufficiently to permit the new leading edge to again advance between the bail 32 and the platen 20 before regular bail bias is re-applied.

While only one exemplary embodiment of this invention has been described in detail, those skilled in the art will recognize that there are many possible modifications and variations which may be made in this exemplary embodiment while yet retaining many of the novel features and advantages of the invention. Accordingly, all such modifications and variations are intended to be included within the scope of the appended claims.

What is claimed is:

1. A printer for printing on paper at a printing station said printer comprising: a downstream paper tear-off edge;

A. tear-off operation initiating means for providing a tear-off operation initiating control signal;

B. data processor means including means responsive to said tear-off operation initiating control signal for generating a paper advance signal and further including time delay means for indicating the expiration of a predetermined time delay from said tear-off initiating control signal and paper retraction initiating means for generating a paper retract signal in response to at least one of the expiration of said predetermined time delay or the actuation of an operator actuatable switch means, said paper advance signal and said paper retract signal being independent of available symbols to be printed;

C. paper advancing and retracting means, responsive to said paper advance signal, for immediately advancing a predetermined portion of said paper from a print line position to a tear-off position adjacent said tear-off edge; and D. said paper advancing and retracting means being responsive to said paper retract signal for subsequently retracting a second predetermined portion of said paper to a new print line position.

2. A printer as in claim 1 having a platen at said printing station and comprising a paper bail means normally biasing the paper toward said platen during printing and responsive to said paper retract signal to disable said bias after said retraction until after subsequent advancement of the paper causes the paper to again pass under the bail means.

3. A printer as in claim 1, wherein said tear-off operation initiating means comprises an operator actuatable switch on a printer control panel.

4. A printer as in claim 1 wherein said operator actuatable switch means is a switch on a printer control panel.

5. A printer as in claim 2 wherein said operator actuatable switch means is a switch on a printer control panel.

6. In a printer for printing on paper at a printing station, said printer including data processor control means and a downstream paper tear-off edge, a method for automating a continuous form paper tear off operation comprising the steps of:

A. producing a tear-off operation initiating control signal indicative of desired paper movement to a tear-off position adjacent said tear-off edge;

B. generating a paper advance control signal by said data processor control means responsive to said tear-off operation initiating control signal;

C. advancing a predetermined portion of said paper from a print line position to the tear-off position without delay in response to said paper advance control signal;

D. determining by said data processor control means the expiration of a predetermined time delay from said tear-off initiating control signal;

E. generating a paper retract signal in response to at least one of the expiration of said predetermined time delay or the actuation of an operator actuatable switch means, said paper advance signal and said paper retract signal being independent of available symbols to be printed; and F. retracting a second predetermined portion of said paper to a new print line position in response to said paper retract signal.

7. A method as in claim 6 further comprising:

temporarily releasing a paper bail at least after said retraction when paper is no longer disposed between the bail and a print platen.

8. A method as in claim 6 wherein said paper retract signal is initiated a predetermined period of time after the occurrence of said tear-off operation initiating signal.

9. A method as in claim 7 wherein said paper retract signal is initiated a predetermined period of time after the occurrence of said tear-off operation initiating signal.

10. A method as in claim 6 wherein said paper retract signal is initiated by depressing a switch on a printer control panel.

11. A method as in claim 9 wherein said paper retract signal is initiated by depressing a switch on a printer control panel.

12. A printer comprising:

a printing line station including a platen;

a paper tear-off station disposed at a tear-off position and downstream of said printing line station and having a structural edge against which paper may be conveniently torn;

tear-off operation initiating means for providing a tear-off operation initiating control signal;

data processor means including means responsive to said tear-off operation initiating control signal for generating a paper advance signal and further including time delay means for indicating the expiration of a predetermined time delay from said tear-off initiating control signal and paper retraction initiating means for generating a paper retract signal in response to at least one of the expiration of said predetermined time delay or the actuation of an operator actuatable switch means, said paper advance signal and said paper retract signal being independent of available symbols to be printed;

paper drive means responsive to said paper advance signal for driving paper successively through said printing line station and on past said tear-off station in a forward direction and for driving a printed portion of said paper forward to a stationary position past said tear-off station, and also responsive to said paper retract signal for driving a non-printed portion of said paper reversely to a new printing line position after permitting a paper tearing-off function to occur.

13. A printer as in claim 12 wherein said data processor means effects said reverse driving motion at a predetermined time delay after advancing a printed portion of paper to the tear-off station.

14. A printer as in claim 13 further comprising a driven bail disposed adjacent said platen and between said printing line station and said paper tear-off station and electrically driveable into engagement with paper passing just downstream of said printing line station and wherein said data processor means includes means for releasing said bail from engagement with the paper at least after reverse driving of the paper from said tear-off station when there is no paper situated thereunder and for driving said bail into paper engagement at other times when paper is present thereunder during printing operations.

15. A printer as in claim 14 wherein said means for driving said bail into paper engagement is also activated after paper advancement to said tear-off position.

16. A printer for automatically moving continuous form paper available from a source to a desired tear-off position comprising:

a paper tear-off edge disposed at a tear-off position;

operator actuatable switch means for providing a tear-off operation initiating control signal;

paper print means disposed at a print position;

data processor means for controlling advancing and retracting of said paper between desired print line positions and desired tear-off positions and including a source of control signals which are independent of available symbols to be printed, said source of control signals including means responsive to said tear-off operation initiating control signal for generating a paper advance signal, said data processor means including paper retraction initiating means including delay means for indicating the expiration of a predetermined time delay from said tear-off operation initiating control signal and for generating a paper retract signal at the expiration of said predetermined time delay;

paper advancing and retracting means responsive to said paper advance signal from said source of control signals to immediately advance said paper a predetermined distance beyond the print line position to the tear-off position, said paper advancing and retracting means being responsive to said paper retract signal from said source of control signals to retract the paper to the print line position after said predetermined time delay from said tear-off operation initiating control signal; and means for suspending printing during the periods of said paper advancement and retraction until said paper is available for printing at said print line position.

17. A printer according to claim 16 further comprising:

a paper bail normally biasing the paper toward a platen and responsive to said paper advance signal and said paper retract signal to: (a) disable said biasing in response to said paper advance signal until after said advancement of said paper, (b) enable said biasing during tear-off, (c) disable said biasing in response to said paper retract signal, and (d) enable said biasing after retraction of said paper when paper is again present between said bail and said platen.

* * * * *